United States Patent [19]

Saur

[11] Patent Number: 4,522,334

[45] Date of Patent: Jun. 11, 1985

[54] THERMOSTATIC CONTROL DEVICE

[75] Inventor: Roland Saur, Stuttgart, Fed. Rep. of Germany

[73] Assignee: Behr-Thomson Dehnstoffregler GmbH, Stuttgart, Fed. Rep. of Germany

[21] Appl. No.: 510,192

[22] Filed: Jul. 1, 1983

[30] Foreign Application Priority Data

Jul. 13, 1982 [DE] Fed. Rep. of Germany ..... 3226104

[51] Int. Cl.[3] ..... F01P 7/02

[52] U.S. Cl. ..... 236/34.5; 236/51

[58] Field of Search ..... 236/34, 34.5, 100, 51

[56] References Cited

U.S. PATENT DOCUMENTS

| | | | |
|---|---|---|---|
| 2,377,028 | 5/1945 | Nicholas | 236/34.5 X |
| 2,401,646 | 6/1946 | Johnson | 236/34.5 X |
| 2,833,478 | 5/1958 | Middleton | 236/34 |
| 2,881,616 | 4/1959 | Clifford et al. | 236/34 X |
| 3,313,483 | 4/1967 | Nallinger | 236/34.5 |
| 4,175,697 | 11/1979 | Dreibelbis | 236/100 X |
| 4,325,508 | 4/1982 | Kunz | 236/51 X |
| 4,347,973 | 9/1982 | Jackson | 236/34.5 |

FOREIGN PATENT DOCUMENTS

| | | |
|---|---|---|
| 861937 | 7/1949 | Fed. Rep. of Germany . |
| 695730 | 8/1953 | United Kingdom . |

*Primary Examiner*—William E. Tapolcai

*Attorney, Agent, or Firm*—Barnes & Thornburg

[57] ABSTRACT

An apparatus for regulating the temperature in the cooling circulation, especially for a combustion motor of a motor vehicle, is provided which includes a thermostatic valve having a thermostatic working element. In order to adjust the temperature in the cooling medium circulation and therewith the temperature of the combustion engine independently of various service conditions or outside influences of the varying values, a working piston of the thermostatic working element is arranged against an adjustable abutment, so that the opening temperature and the control characteristics of the thermostatic valve can be adjusted or regulated by adjusting the position of the abutment.

21 Claims, 5 Drawing Figures

THERMOSTATIC CONTROL DEVICE

BACKGROUND AND SUMMARY OF THE INVENTION

The present invention relates generally to an apparatus for controlling the temperature in a cooling circulation of a combustion motor, such as that in a vehicle, of the type which includes a thermostatic valve for controlling the cooling medium flow from the combustion motor through a direct return and/or via a heat exchanger back to the combustion motor. More particularly, the present invention relates to thermostatic controls responsive to the motor temperature as well as other control variables, such as the temperature of the exterior environment.

It has been long known to control the temperature of the cooling medium and, thereby, the temperature of the combustion motor, especially during the start of the combustion motor, by providing a thermostatic valve which is so adjusted that the connection to the heat exchanger is opened up only after a predetermined temperature below the operating temperature is achieved by the cooling medium. The combustion motor is thus warmed to its operating temperature in the shortest possible time.

The temperature of the exterior environment has a significant influence on the warm-up time. The operating temperature is reached more quickly when the exterior temperature is higher than when the exterior temperature is lower. A thermostatic valve which opens at a temperature which is too far beneath the operating temperature retards the achievement of the operating temperature, especially with low exterior temperatures. With low exterior temperature it is therefore desired that the thermostatic valve open first at a higher cooling medium temperature. With high exterior temperatures, this thermostatic valve should, however, be open at a significantly lower temperature so that the operating temperature of the motor is not over-shot. Such a thermostatic valve has been recognized as a desirable feature in combustion motors for some time. Previous devices which sought to achieve this result include the so-called winter-thermostatic valves for lower outside temperatures and summer thermostatic valves for higher outside temperatures. However, these devices require additional servicing procedures and, more importantly, present a danger of motor damage because of an incorrect selection of the proper thermostatic valve.

In order to solve the above-described problem, it has also been known to create a unitary apparatus which is adjustable to correspond to the exterior temperature. None of the previously known unitary devices has, however, found extensive use in practice because of their excessive costs and low reliability. For example, DE-OS No. 14 51 669 (German published application) provides two thermostatic working elements which interchangably or consecutively come into operation. The relative position with respect to the valve plate of these two thermostatic working elements individually or together is changeable, thus making relative movement within the thermostat necessary. Such movement results in increased production costs as well as the problem of providing a guidance member between the valve plate and thermostatic working elements. This guidance member is very sensitive to disturbance and must be constructed within close dimensional tolerances.

An object of the present invention is the provision of a mechanically simple and functionally reliable thermostatic valve for combustion motors.

Another object is to provide a thermostatic control responsive to motor temperature as well as the exterior temperature and other operating parameters.

These and other objects of the present invention are obtained in an adjustable abutment which forms a support for the working piston of the thermostat so that the distance to the valve plate housing is adjustable. By changing the relative position of the abutment with respect to the thermostatic working element, it is possible to change the working temperature region of the thermostatic valve. A basic structural change in conventional valve constructions is, thus, not necessary. Further, the working region can be switched not only to extreme positions, but also intermediate positions, so that an efficient thermostatic control is possible taking into account exterior temperatures as well as other operating conditions, such as exhaust temperature, motor rotational speed or rational movement, oil temperature, and the pressure differential in a vacuum pipe. It is possible in view of these factors to change the motor temperature within certain limits in order to optimize the operation of the combustion motor.

Other objects, advantages, and novel features of the present invention will become apparent from the following detailed description of the preferred embodiments when considered in conjuction with the drawings.

DETAILED DESCRIPTION OF THE DRAWINGS

Figure 1:
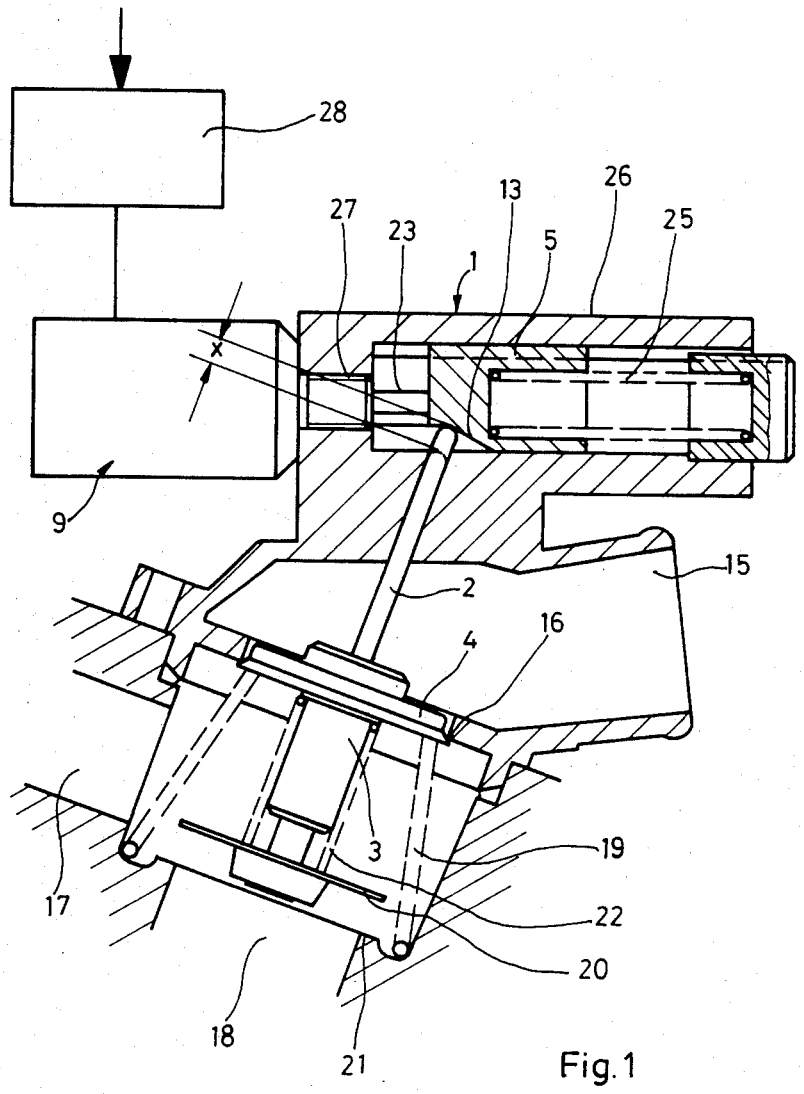
FIG. 1 is a schematic part-sectional view which shows a cross section through a temperature control apparatus constructed in accordance with a preferred embodiment of the present invention.

FIG. 1, which illustrates a preferred embodiment of the present invention, shows a temperature control system having an inlet 17 for the cooling fluid of a combustion motor which is connectable by means of a thermostatic valve with direct return 18 and/or with a connection port 15 leading to a heat exchanger (not illustrated). A fluid flow line leads further from the heat exchanger back to the combustion motor (also not illustrated). The thermostatic valve includes a thermostatic working element, such as working piston 2 and housing 3. Temperature responsive expandable material is arranged in housing 3 which expands when heated and drives working piston 2 outwardly of housing 3. Upon cooling, the expandable material reduces its volume so that the working piston 2 is withdrawn back into housing 3.

Valve plate 4 is fixedly attached to housing 3 of the thermostatic working element by, for example, pressure fit or flange connection. Valve plate 4 includes a conical rim disposed at an angle with respect to valve seat 16, which is formed from connection member 15. The valve formed from valve plate 4 and valve seat 16 closes or opens the connection between inlet 17 and connection 15 leading to the heat exchanger. Valve plate 4 is biased toward valve seat 16 by a conical compression spring 19 in the illustrated closed position.

A lower valve plate 20 is attached to housing 3 and retained by means of a slide guide adjacent direct return 18 such that direct return 18 provides a valve seat for valve plate 20. Valve plate 20 is directionally biased toward direct return 18 by means of compression spring 22 which is supported between valve plate 4 and valve plate 20 and about housing 3. Inlet 17 is located between the planes of valve plates 4 and 20. Working piston 2 of the thermostatic working element is expandable to be supported at an abutment housing 1.

During the startup of the combustion engine and the free circulation of the cooling medium, the thermostatic valve is in the position illustrated in FIG. 1; the passageway from inlet 17 to connection member 15 is closed and the passageway to direct return 18 is open. The cooling medium flows past the housing 3 of the thermostatic working element. When a predetermined circulatory fluid temperature is reached, through the expansion of the expansion material of the thermostatic working element, working piston 2 will extend outwardly from housing 3. Working piston 2 expands while in contact with abutment housing 1 and thereby moves housing 3 and valve plates 4 and 20 so that over a certain temperature range first both valve plates 4 and 20 are open and eventually, upon further increase in the temperature, valve plate 20 is closed and only valve plate 4 is open.

The working temperature region of the thermostatic valve may be adjusted to different temperature levels from outside the thermostat, in addition to the adjustment by selection of the expansion material to establish different temperature responsive regions. Abutment housing 1 is provided with an adjustable abutment body 5 which is independent of and moveable relative to the thermostatic working element. Body 5 is slidable diagonally with respect to the longitudinal axis of working piston 2 and is provided with abutment surface 13 diagonally inclined with respect to the longitudinal axis of working piston 2.

By moving abutment body 5 diagonally with respect to working piston 2, the respective operational support points can be adjusted to varying distances from housing 3 and valve plate 4 up to a distance X. Since body 5 may be accessed from outside the thermostat, the working temperature region of the thermostatic valve is changeable from outside. The sliding direction of abutment body 5 and the inclination of support surface 13 may be selected relative to the longitudinal axis of working piston 2 so that a desired adjusting movement of abutment body 1 will result with a particular change in the distance X. As illustrated in FIG. 1, abutment body 5 is located so as to permit working piston 2 to extend the farthest distance from housing 3 when using abutment body 5 as a support point for opening of valve 4 and closing of the valve 20. This results in an increased temperature of the cooling medium, which, for example, is desired with lower exterior temperatures. Working piston 2 must first move a distance X before it actually abuts at the supporting surface 13 and, through a further extension out of the housing 3, can move valve plates 4 and 20.

By moving abutment body 5 out of its illustrated extreme position and toward the left, distance X can be decreased and, thus, the working temperature region of the thermostatic working element and the thermostatic valve can be adjusted to a lower temperature level, as would, for example, be desired with higher exterior temperatures. By similar fluid heating of the thermostatic working element, working piston 2 may then reach abutment surface 13 earlier, so that the opening movement of valve 4 and closing movement of valve 20 begins earlier. As is readily understood by those skilled in the art, the abutment points at diagonally extending support surface 13 can be selected between the extreme positions so that the working region of the thermostatic valve can be adjustable in a continuous manner over the entire region.

The motion of abutment body 5 within abutment housing 1 is brought about by means of an adjusting member or second thermostatic working element 9, which is formed with a thermostatic working element having working piston 23. When heated, working piston 23 travels outwardly from thermostatic working element 9. Cooling results in a corresponding return movement. A return adjustment spring 25 is provided which biases abutment body 5 toward working piston 23 so as to follow this return movement. Body 5 is coaxially extending with respect to working piston 23, which is slidably guided in a guide housing 26. Housing 26 is integrally formed with connection member 15. Thermostatic working element 9 is threadably connected to housing 26 by a threaded connection 27.

The thermostatic working element 9 may be provided with an electrical heating element, for example a PTC-resistor, so that the linear movement of working piston 23 to provide adjustment of the working temperature region of the thermostatic valve can be electrically controlled. The current input to thermostatic working element 9 is by means of a schematically illustrated signal controller 28 which can be activated by various conventional control signals. It is possible that not only the exterior temperature but also (or alternatively), for example, the exhaust gas temperature, the rotational speed or the rotational moment (torque) of the combustion engine, the vacuum in the suction pipe, the pressure difference in a vacuum pot, or the oil temperature may be the source for these control signals to adjust the thermostatic valve working temperature region. In order to accommodate the adjustment of the working temperature region of the thermostatic valve and also the partial or complete extension of working piston 2 of the thermostatic working element, return spring 25 must be so constructed that it can overcome the force of spring 19 when valve plate 4 and housing 3 are moved by working piston 2.

In the illustrated embodiment, connection member 15 may be constructed as an integral unit with the thermostatic valve and abutment housing 1. The internal elements of abutment 1 may be assembled as a unit and can be readily exchanged as a unit.

The embodiment according to FIG. 1 can also be modified so that the apparatus functions without the input of auxiliary energy for these conrol signals; thermostatic working element 9 can cause an adjustment of abutment body 5 independently of other component sensors of exterior temperature or the like. For example, thermostatic working element 9 can, through the selection of expansion material contained therein, be so constructed that with lower exterior temperatures up to, for example, 15° centigrade the opening of valve plate 4 begins only after the cooling medium obtains a higher temperature than the exterior temperature. In this case, the arrangement illustrated in FIG. 1 could be modified such that the positions of thermostatic working element 9 and return spring 25 are reversed. Thus, rightward motion of working piston 23 toward thermostatic working element 9 in response to lower exterior temperatures causes the support point of support surface 13 to move further from working piston 2 of housing 3, and an increased cooling medium temperature is necessary to cause valve plate 4 to move away from valve 16. Likewise, leftward motion of working piston 23 in response to higher external temperatures permits valve plate 4 to respond to lower fluid temperatures.

FIGS. 2 to 5 show further embodiments of the present invention for the adjusting of the working temperature region of a thermostatic valve corresponding to that shown in FIG. 1 wherein an adjustable abutment body is provided. Linear adjusting drive or rotational adjusting drive may be alternatively provided. The illustrated embodiments show only a partial cross-section of various possibilities which can be used with or without the addition of auxiliary energy or sensors for control signals. These embodiments can also be employed with hydraulic or pneumatic adjustment members.

Figure 2:
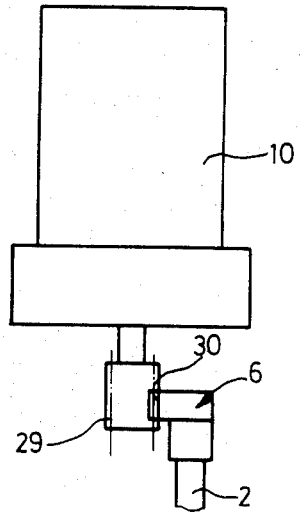
FIG. 2 is a partial schematic view of a temperature control apparatus constructed in accordance with a second preferred embodiment of the present invention.
Figure 3:
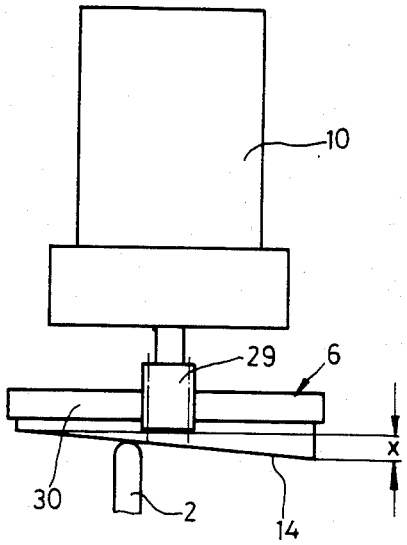
FIG. 3 is a side view of the embodiment shown in FIG. 2.

FIGS. 2 and 3 illustrate the use of rotation motor 10 as the adjusting member for abutment body 6, with a driving pinion 29 in a steering rack 30 which engages and is movable back and forth with respect to the longitudinal axis of working piston 2 in order to adjust the working temperature region. Steering rack 30 is provided with a support surface 14 having a surface which is diagonal to the longitudinal axis of working piston 2. Rotation of motor 10 is so arranged that it also can work against the biasing force of spring 19 of the thermostatic valve.

Figure 4:
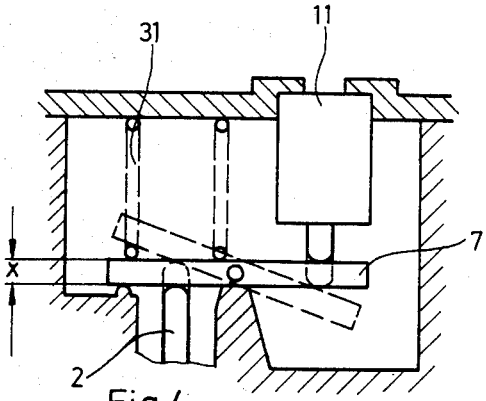
FIG. 4 is a schematic part-sectional view of a temperature control apparatus constructed in accordance with a third preferred embodiment of the present invention.

FIG. 4 illustrates an adjusting member 11 for linear driving movement comprising, for example, a thermostatic element or a solenoid or a motor with a turning spindle, which loads an abutment body 7 having dual lever arms and which is pivotable about an axis extending perpendicularly to the longitudinal axis of working piston 2 and out of the plane of the drawing. Lever 7 is loaded with a compression spring means 31 extending coaxially with working piston 2 and which biases lever 7 toward the return position (shown in solid lines in FIG. 4).

Figure 5:
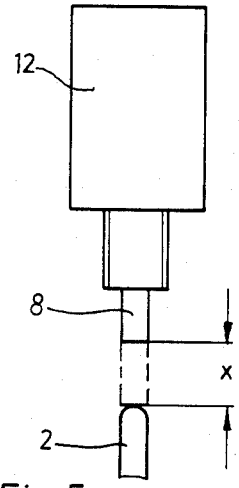
FIG. 5 is a schematic view of a fourth preferred embodiment of the present invention.

FIG. 5 illustrates abutment body 8 which is adjustable coaxially with the longitudinal axis of working piston 2. Support body 8 is, for example, the working piston of the thermostatic working element 12 that is electrically heated with auxiliary energy or functioning without auxiliary energy in response to the external temperature. In the latter case working element 12 may be provided with a working piston which remains inside of element 12 during low external temperatures and emerges after a certain external temperature is detected. Alternatively, abutment body 8 can also be the spindle of rotational motor or the piston of a solenoid.

Further, instead of the tooth arrangement shown in the embodiment of FIGS. 2 and 3, an outer toothed disc may be provided having an axis parallel to the axis of pinion 29, and which is provided with a cam surface serving as a support surface through which the different working temperature regions for the working piston can be adjusted.

While we have shown and described several embodiments in accordance with the present invention, it is understood that the same is not limited thereto but is susceptible to numerous changes and modifications as would be known to those skilled in the art of the present disclosure and we therefore do not wish to be limited to the details shown and described therein but intend to cover all such changes and modifications as are encompassed by the scope of the appended claims.

What is claimed is:

1. An apparatus for the regulation of the temperature in a cooling circulation of a combustion motor which includes a thermostatic valve means for controlling the cooling medium flow from the combustion motor through a direct return and a heat exchanger to the combustion motor, said valve means including a thermostatic working element having a housing which supports a valve plate for controlling flow leading to the heat exchanger and a working piston which engages against an abutment body within an abutment housing and which moves outwardly in response to heating; wherein a second thermostatic working element is provided as a position adjusting member connected to said abutment body, and wherein the position of said abutment body is adjustable such that the point of engagement with said working piston may be varied to change the distance to said housing and valve plate.

2. The apparatus according to claim 1, wherein said position adjusting member is operated by means of auxiliary energy.

3. The apparatus according to claim 1, wherein said abutment body is adjustable in the axial direction of said working piston.

4. The apparatus according to claim 1, wherein said abutment body is a rotatable disc which exhibits a cam surface facing said working piston.

5. The apparatus according to claim 1, wherein said abutment housing is formed integrally with a connecting branch leading to said heat exchanger.

6. The apparatus according to claim 5, wherein said connecting branch is formed with a valve seat for said valve plate connected to said housing of the thermostatic working element.

7. The apparatus according to claim 5, wherein said connecting branch, said abutment housing, and said adjusting member form a removable thermostatic unit.

8. The apparatus according to claim 6, wherein said connecting branch, said abutment housing, and said adjusting member form a removable thermostatic unit.

9. An apparatus for the regulation of the temperature in a cooling circulation of a combustion motor which includes a thermostatic valve means for controlling the cooling medium flow from the combustion motor through a direct return and a heat exchanger to the combustion motor, said valve means including a thermostatic working element having a housing which supports a valve plate for controlling flow leading to the heat exchanger and a working piston which engages against an abutment body within an abutment housing and which moves outwardly in response to heating; wherein a position adjusting member is provided which is connected to said abutment body which is operated by means of auxiliary energy and includes an electrically heatable thermostatic working element, and wherein the position of said abutment body is adjustable such that the point of engagement with said working piston may be varied to change the distance to said housing and valve plate.

10. An apparatus for the regulation of the temperature in a cooling circulation of a combustion motor which includes a thermostatic valve means for controlling the cooling medium flow from the combustion motor through a direct return and a heat exchanger to the combustion motor, said valve means including a thermostatic working element having a housing which supports a valve plate for controlling flow leading to the heat exchanger and a working piston which engages against an abutment body within an abutment housing and which moves outwardly in response to heating; wherein a position adjusting member is provided which is connected to said abutment body, wherein said abutment body is adjustable diagonally to the axis of said working piston and is provided with an inclined support surface extending diagonally to the axis of said working piston, and wherein the position of said abutment body is adjustable such that the point of engagement with said working piston may be varied to change the distance to said housing and valve plate.

11. The apparatus according to claim 10, wherein said abutment housing is formed integrally with a connecting branch leading to said heat exchanger.

12. The apparatus according to claim 11, wherein said connecting branch is formed with a valve seat for said valve plate connected to said housing of the thermostatic working element.

13. The apparatus according to claim 11, wherein said connecting branch, said abutment housing, and said adjusting member form a removable thermostatic unit.

14. An apparatus for thermostatically controlling the temperature of coolant fluid circulating in a motor comprising:

inlet means for coolant fluid;

thermostatic valve means for selectively communicating said inlet means with direct return means and with connection port means to a heat exchange means, including valving means for controlling fluid flow through said direct return means and connection port means and thermostatic working means for actuating said valving means;

and adjustable abutment body adjustably disposed and slidable in an abutment housing adjacent said thermostatic valve means having a contact surface engageable by and positionable at varying distances from said thermostatic working element means so as to define the coolant temperature range at which said valving means will be actuated, and wherein said thermostatic working element includes piston means extending into said abutment housing and operably engageable with said contact surface in response to coolant fluid temperature, and wherein said contact surface is inclined with respect to the longitudinal axis of said piston means; and abutment body adjustment means for adjusting the position of said abutment body.

15. The apparatus according to claim 14, further including external control means to adjust the position of said abutment body and said contact surface in response to operating conditions external to the coolant fluid circulation.

16. The apparatus according to claim 15, wherein said external control means includes geared means for engaging and displacing said abutment body.

17. The apparatus according to claim 15, wherein said abutment body includes lever means biased by said external control means to engage said thermostatic working element means at various distances therefrom.

18. The apparatus according to claim 15, wherein said external control means includes direct, in-line mechanical linkage means to displace said abutment body and said piston means.

19. An apparatus for thermostatically controlling the temperature of coolant fluid circulating in a motor comprising:

inlet means for coolant fluid;

thermostatic valve means for selectively communicating said inlet means with direct return means and with connection port means to a heat exchange means, including valving means for controlling fluid flow through said direct return means and connection port means and thermostatic working means for actuating said valving means;

an adjustable abutment body adjustably disposed in an abutment housing adjacent said thermostatic valve means having a contact surface engageable by and positionable at varying distances from said thermostatic working element means so as to define the coolant temperature range at which said valving means will be actuated, and said thermostatic working element including piston means extending into said abutment housing and operably engageable with said contact surface in response to coolant fluid temperature;

abutment body adjusting means for adjusting the position of said abutment body and including external control means to adjust the position of said abutment body and said contact surface in response to operating conditions external to the coolant fluid circulation;

said external control means being automatically adjustable in response to external temperature.

20. An apparatus for thermostatically controlling the temperature of coolant fluid circulating in a motor comprising:

inlet means for coolant fluid;

thermostatic valve means for selectively communicating said inlet means with direct return means and with connection port means to a heat exchange means, including valving means for controlling fluid flow through said direct return means and connection port means and thermostatic working means for actuating said valving means;

an adjustable abutment body adjustably disposed in an abutment housing adjacent said thermostatic valve means having a contact surface engageable by and positionable at varying distances from said thermostatic working element means so as to define the coolant temperature range at which said valving means will be actuated, and said thermostatic working element including piston means extending into said abutment housing and operably engageable with said contact surface in response to coolant fluid temperature;

abutment body adjusting means for adjusting the position of said abutment body and including external control means to adjust the position of said abutment body and said contact surface in response to operating conditions external to the coolant fluid circulation;

said external control means is automatically adjustable in response to changes in the operating conditions and characteristics of said motor.

21. An apparatus for thermostatically controlling the temperature of coolant fluid circulating in a motor comprising:

inlet means for coolant fluid;

thermostatic valve means for selectively communicating said inlet means with direct return means and with connection port means to a heat exchange means, including valving means for controlling fluid flow through said direct return means and connection port means and thermostatic working means for actuating said valving means;

an adjustable abutment body adjustably disposed in an abutment housing adjacent said thermostatic valve means having a contact surface engageable by and positionable at varying distances from said thermostatic working element means so as to define the coolant temperature range at which said valving means will be actuated, and said thermostatic working element including piston means extending into said abutment housing and operably engageable with said contact surface in response to coolant fluid temperature;

abutment body adjusting means for adjusting the position of said abutment body and including external control means to adjust the position of said abutment body and said contact surface in response to operating conditions external to the coolant fluid circulation;

said external control means includes a second thermostatic working element in contact with said abutment body and operable to displace said abutment body.

* * * * *

UNITED STATES PATENT AND TRADEMARK OFFICE

CERTIFICATE OF CORRECTION

PATENT NO. : 4,522,334

DATED : June 11, 1985

INVENTOR(S) : Roland Saur

It is certified that error appears in the above-identified patent and that said Letters Patent is hereby corrected as shown below:

Title page:

Item No. 73 should read:

-- Behr-Thomson Dehnstoffregler GmbH, 7014 Kornwestheim, Fed. Rep. of Germany --.

Signed and Sealed this

*Nineteenth* Day of *November 1985*

[SEAL]

*Attest:*

DONALD J. QUIGG

*Attesting Officer*

*Commissioner of Patents and Trademarks*